US008580338B1

(12) United States Patent
Dronzek, Jr.

(10) Patent No.: US 8,580,338 B1
(45) **Date of Patent: *Nov. 12, 2013**

(54) EMBOSSED DURABLE SUPPORTS WITH RFID CHIP, FOR LABELING AND RELABELING OBJECTS

(75) Inventor: Peter Dronzek, Jr., Thornwood, NY (US)

(73) Assignees: Polymeric LLC, Enfield, CT (US); FilmLOC Inc., Atlanta, GA (US)

( * ) Notice: Subject to any disclaimer, the term of this patent is extended or adjusted under 35 U.S.C. 154(b) by 186 days.

This patent is subject to a terminal disclaimer.

(21) Appl. No.: 12/928,848

(22) Filed: Dec. 21, 2010

Related U.S. Application Data

(62) Division of application No. 11/726,948, filed on Mar. 23, 2007, now Pat. No. 7,892,598.

(60) Provisional application No. 60/875,678, filed on Dec. 19, 2006.

(51) Int. Cl.
*B05D 5/10* (2006.01)

(52) U.S. Cl.
USPC ..... 427/207.1; 427/208.2

(58) Field of Classification Search
USPC ..... 427/207.1, 208, 208.2, 208.4
See application file for complete search history.

(56) References Cited

U.S. PATENT DOCUMENTS

| | | | | |
|---|---|---|---|---|
| 5,628,858 | A * | 5/1997 | Petrou | 156/249 |
| 6,147,662 | A * | 11/2000 | Grabau et al. | 343/895 |
| 2002/0081446 | A1 * | 6/2002 | Boudouris et al. | 428/469 |
| 2003/0067381 | A1 * | 4/2003 | Mitchell et al. | 340/5.92 |
| 2003/0129343 | A1 * | 7/2003 | Galkiewicz et al. | 428/40.1 |

* cited by examiner

*Primary Examiner* — Nathan Empie
*Assistant Examiner* — Xiao Zhao
(74) *Attorney, Agent, or Firm* — Robert Gorman; Gorman Law Offices

(57) ABSTRACT

A self adhesive embossed support comprising:

(a) a resin film which may be a thermoplastic or a thermoset resin having at least one embossed surface for receiving a removable element where the embossed surface has a reduced surface area of contact that allows for removal of an adhesive backed element without leaving any substantial adhesive residue; and an adhesive side on the side of the resin film opposite the receiving side with the embossed surface with an adhesive having an ultimate release energy level greater than the attraction forces between the embossed film and a substrate to be removed;

(b) the substrate receiving side consisting of a reduced surface area surface to facilitate release of the applied element without making use of a coated release substance or film made with materials that have inherent release characteristics that are adapted to support a removable element attachable thereto by means comprising attraction forces between the resin film and the substrate.

10 Claims, 6 Drawing Sheets

PRIOR ART

PRIOR ART

EMBOSSED DURABLE SUPPORTS WITH RFID CHIP, FOR LABELING AND RELABELING OBJECTS

REFERENCE TO RELATED APPLICATIONS

This application is a divisional of U.S. application Ser. No. 11/726,948, filed Mar. 23, 2007 now U.S. Pat. No. 7,892,598, which in turn claims priority from U.S. provisional filing 60/875,678, filed on Dec. 19, 2006, both of which are hereby incorporated by reference.

FIELD OF THE INVENTION

This invention relates to supports used in labeling and relabeling objects such as pallet racks, reusable containers, reusable signage and, more particularly, to supports which provide a durable, reusable surface for pressure-sensitive adhesive backed materials applied with minimal force.

BACKGROUND OF THE INVENTION

In the production and merchandising of goods, it is often desirable to make use of removable coupons, signage or labels contained on supports, containers, folders or packages that function as changeable signage such as for advertising, redeemable retail coupons, inventory control labels, and the like. In these functions, it is desirable and often necessary that the removable piece not be prone to premature detachment during exposure to the elements if signage, shipping and handling if a reusable container, premature loss if a coupon with value and yet be readily and cleanly removable.

Furthermore, inventory control labels, especially those affixed to reusable signage and containers, are subject to abrasion during shipping and handling and to chemical attack by spillage of the container contents. Abrasion and chemical attack can destroy important information on the label and result in premature detachment of the label from chemical attack and, in the case of relabeling where the release surface is a coated release surface such as a silicone coating, can increase the difficulty in removability of the label.

French Patent 2 649 522 to Raffegeau describes a coated film or paper element having a silicone coating on one side and an adhesive on the opposite side. This structure is used on reusable containers as a relabeling substrate to avoid a messy build up of adhesive when an old label is removed to be replaced with a new label.

U.S. Pat. No. 4,767,654, to Riggsbee "DETACHABLE COUPON LABEL", describes a label structure appropriate for attaching to packages or containers which permits the coupon label to be readily detached without leaving a tacky residue and without the use of a coated release substance. Specifically, Riggsbee requires the use of London or dispersion forces to attach the coupon at a desirable release force, in the range of 10-100 g/inch width, to a base sheet without making use of either an adhesive or a coated release substance. To accomplish his objectives, Riggsbee requires that the coupon layer be the substrate for "casting" a thin extruded film of resin so as to retain detachability without damage to the substrate and without leaving a tacky residue.

U.S. Pat. No. 5,628,858 and RE37,164 to Petrou "LABEL SYSTEM FOR REUSABLE CONTAINERS AND THE LIKE", requires the use of a multilayer laminate called a "placard" having a release coating on one side and an adhesive on the other side for securing the placard to the container. The placard may be partially transparent with instructional printing applied to one surface. Pressure-sensitive labels are placed on the exposed release-coated surface of the placard. The labels contain indicia relating to the status of the container. When the status of the container changes, the label is removed and a new label is substituted on the placard. As a preferred embodiment, the placard is provided on one face with a coated silicone release substance.

U.S. Pat. Nos. 6,986,826 and 6,667,086, to Dronzek, Jr. disclose that an extruded and subsequently laminated Teflon® film overlaminate provides a placard having a more durable release surface than the coated release surface of the Petrou placard. While this product which is based on a solid extruded film at least 0.5 mil in thickness is a major improvement over a coated release system that is subject to loss of release properties, loss of performance through abrasion and loss of coating over repeated used, Teflon along with other fluoropolymer based films having release properties are very costly and are not cost competitive with release coated packaging films such as release coated polypropylene.

U.S. Patent Publication No. 2006-0054266 to Kennedy, describes placards inserted with RFID transponders that achieves a release film surface for the removal of pressure sensitive labels by using a pliable film that forms a hermetic seal and has a release surface which may be a coating applied to a protective layer or may be a property of the material from which the protective layer is made.

Entirely different approaches to embossed surfaces have been used in the past as separation sheets for items such as rubber and other materials that could stick together as a means to promote separation. They also have been used in a limited way as release backing for pressure sensitive tapes manufactured from durable face stocks such as films and foils (not paper based) so they are strong enough to be removed without destruction as bond builds over time. In these applications, a very firm adhesive system is used. The adhesive needs to be firm because as the tape is rolled up under tension, if the adhesive is not firm, it will be forced under pressure to flow into the embossed cavity and will bond and not readily remove. Embossing a film increases the overall surface area as compared to a flat smooth surface. If the adhesive is not firm and is applied with pressure, such as in a wound roll or stack, in many cases it will actually develop a stronger bond over time because of penetration into the embossed area than the same adhesive would on a smooth surface of the same material.

Entirely different approaches to embossed polymeric substrates have been used in a limited way in the label arts as release backings in combination with durable polymeric substrate face stocks as in the tape arts also with very firm adhesives. These adhesives are typically classified as removable because they remove cleanly from many surfaces and are much more costly than typical adhesive systems used on paper labels. Because they are firm, they do not readily flow into the embossed cavity, but if they do the durable polymeric face stock can still be separated without destruction.

Entirely different approaches to films with embossed surfaces have been used as liners having a release surface in combination with adhesive film products having high tensile strengths. These high tensile strength products will resist tearing and deformation when they are separated from the textured or embossed film surface. However, in the prior art, textured or embossed films have not been used as release liners for paper labels because of the tendency of paper labels, due to the low tensile strength of paper, to tear when removed from a film surface that does not have a release coating or has not been made from a material with inherent release characteristics like fluoropolymers. This occurs after they have been in place for a prolonged period of time where the adhesive has had a chance to build, particularly under adverse conditions such as pressure from being wound in a roll or when placed under a force such as a stack of labels and subjected to temperature, causing the adhesive to soften and flow under pressure or load.

BRIEF DESCRIPTION OF THE DRAWINGS

The invention is illustrated in the accompanying drawings in which.

SUMMARY OF THE INVENTION

Figure 1:
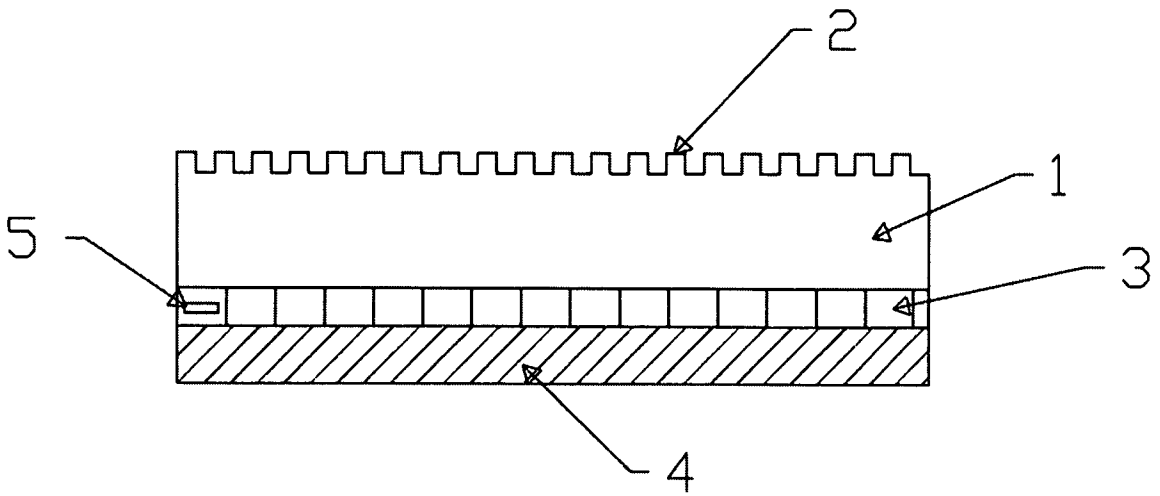
FIG. 1 is a block diagram view, partially exploded, of a first support structure constructed in accordance with the present invention.

It has now been found that durability and reliability of the multi-use support structure will be vastly increased by providing and using as a support structure an embossed resin film made without using a coated release substance, such as a release coating (for example a silicone coating or added wax or release agents). The embossed resin film must have a sufficiently high Ra factor and reduced contact surface area so that it will allow release of an adhesive affixed element without leaving any substantial adhesive residue on the embossed surface when removed.

"Durability" of this support structure is increased, compared to that achieved with the coated release surface and will also have superior ultraviolet (UV)-light resistance, abrasion resistance, anti-corrosives resistance, sterile packaging conditions resistance, chemical resistance, and the like. Reliability is enhanced by avoiding the use of a coated release substance, such as a silicone release coating, which, once abraded through the coating, causes the pressure sensitive adhesive-backed label or labels to stick and possibly even tear by contact with the underlying surface, and/or to distort or lose valuable printed information. Re-labeling is significantly improved because the embossed substrate lends itself to use over and over again. Additionally, many temporary labels are removed and reapplied to other containers or areas for control and tracking purposes at various steps of manufacturing, packaging, storage and distribution, so the improved removability of the labels provided by the present invention is advantageous at a fraction of the cost of expensive extruded film laminates manufactured from films made with materials that have inherent release characteristics like fluoropolymer resins, which involve high raw material costs and additional converting steps.

Accordingly, an objective of the invention is to provide a durable low cost support structure for use in labeling and relabeling using paper based pressure-sensitive adhesive-backed labels.

Another objective is to provide a durable support structure for use in labeling and relabeling using an adhesive-backed laminate having a disposable liner covering the adhesive.

These and other objectives of the invention will become apparent from the present specification.

According to this invention, there are provided durable self adhesive embossed supports in roll, sheet, fan-fold, or rigid form without adhesive that can be bolted or riveted on, or attached with magnetic strips or sheets for use as support structures for labeling and re-labeling of objects such as pallet racks, reusable containers, reusable marketing signage etc. In at least one embodiment the above is provided for so as to prevent deformation and/or flow from weight or storage pressures, and may allow for direct application. The inventive structure and process is also intended for single use labeling in the industrial production of products where it is desired to place indicia of a model number or manufacturers indicia on the finished product which would be printed on the support but during production it is desired to have a temporary or a removable label that may contain the customer's order information, serial number, part number or manufacturing directions etc, that are to be removed from the product before it is shipped to a customer or after the customer receives it. These temporary labels or the support may contain an RFID (Radio Frequency Identification Device) chip for use with conventional electronic RFID readers or other electronic tracking devices. The use of an embossed film with an RFID chip in an element or label applied to the embossed surface or embedded as part of the support is advantageous in that the embossed film will impart a cushioning effect that will tend to protect the RFID chip or other electronic tracking device from damage.

The self adhesive embossed support comprises:

(a) a resin film which may be a thermoplastic or a thermoset resin having at least one embossed surface for receiving a removable element known as the receiving side where the embossing has an Ra factor and reduced surface area of contact that allows for removal of an adhesive backed element without leaving any substantial adhesive residue; and an adhesive side, on the side of the resin film opposite the receiving side with the embossed surface, with an adhesive having an ultimate release energy level greater than the attraction forces between the embossed film and a substrate to be removed (b) the embossed surface side, consisting of a reduced surface contact area to facilitate release of the applied element without making use of a coated release substance or film made with materials that have inherent release characteristics, that is adapted to support a removable element attachable thereto by means comprising attraction forces between the resin film and the substrate; and optionally (c) a temporary backing in contact with the adhesive, the backing being adapted subsequently to be stripped from contact with the adhesive to allow the embossed support to be mounted on a reusable container or an object for labeling or relabeling, or attached to a magnetic strip allowing placement on metal surfaces.

Also contemplated as a one embodiment of the present invention are embossed supports as defined above wherein:

(i) the removable element may be a label or labels comprising a pressure-sensitive adhesive-backed label or labels;

(ii) the release force between the removable label or labels and the resin film, having the controlled-release surface without making use of a release substance is about 5 to about 100 grams per inch width, and the adhesion energy level of the adhesive is greater than the release force between the label or labels and the embossed resin film that facilitates release without making use of a coated release substance or manufacturing the film from materials with inherent release characteristics; and especially those wherein the release force, between the label or labels and the embossed film having the release surface characteristics without making use of a coated release substance or a film made from materials with inherent release characteristics, is about 20 to about 60 grams per inch width, although variations thereon are conceivable.

An additional embodiment comprises the application of a single layer of a low tensile strength removable label element, such as one made out of paper having a pressure sensitive adhesive, to a vertically disposed, embossed support that can be reused is different than the way that entirely different embossed films may have been used as release surfaces with high tensile strength materials such as polyester wound in rolls. These rolls have been wound under tension or in stacks under load. In at least one embodiment of the present invention, the vertical position is employed so as to avoid the results of pressure or load, such that there is minimal adhesive penetration with the vertically arranged embossed surface after the initial pressure sensitive application. In alternative embodiments, however the invention is not limited to the use of the embossed support element in the vertical position.

Optionally, instead of using an adhesive to affix the embossed support to an object, it can be removably attached by bolts or laminated to a magnetic element, permanently attached by rivets or other fastening means, such that the bond of the support to the object is greater than the force required to remove an element from the reduced surface area embossed surface.

As used herein, the term "embossed surface" means a textured surface which has formed peaks and valleys in select areas of the surface. The height from the top of the peak to the bottom of the valley (the Ra factor) is designed along with the size and shape of the peak as well as the density of the peaks on the surface (i.e. the number of peaks per sq. cm.) which are used to reduce the surface area of contact relative to the plane of the film to limit the surface area that can come in contact with adhesive. The textured surface can be achieved through mechanical embossing or casting the film on a chilled casting roll as the film is manufactured. Before texturing or embossing, the raw or unprocessed surface of the film does not have the release characteristics required for the present invention because the materials the film is made from do not have release properties or wax or release agents added. For purposes of this invention, textured and embossed are taken to be synonymous.

DETAILED DESCRIPTION OF THE INVENTION

The resin film for the support may be manufactured from a mono-layer or co-extruded layer of polymeric film which may be used as such, or as the outer surface of a flexible or rigid laminated structure. The materials are preferably contact clear and are embossed in-line during the extrusion manufacturing process when the film is manufactured, or is done subsequently out of line with extrusion in a separate process, or is done even in-line with printing or lamination with adhesive. The embossed support has two faces or sides which are the adhesive face or side to which an adhesive is applied to enable the user to affix the support to an object and a controlled release element receiving side accomplished through surface area reduction through embossing which allows the end user to cleanly remove a label, coupon or signage affixed with a pressure sensitive adhesive. At least one surface is embossed, but for certain surface patterns, it is more convenient to simultaneously emboss both sides using male and female rollers.

In any case, however the embossed film should be greater than about 0.001 inch thick. One preferred range of thickness is about 0.002-0.010 inches thick, as measured peak to peak after embossing for adhesive affixed supports and >0.010 inches for non adhesive affixed supports.

Preferably, the embossed films are manufactured from extruded resin films by casting the molten resin on a textured cooled casting drum, or by mechanical compression through a matched set of male and female textured rolls under pressure or one textured male roll with a rubber roll under pressure. Additionally, for specialized patterns of unique resins, textured films can be formed by chemical treatment (etching) of the surface or through laser engraving.

Various embossed patterns are available in finishes and textures for example such as orange peel, grit, sand, diamond, taffeta, split diamond, leather, linen and satin. The embossed pattern can cover the entire element receiving side of the support or can be pattern embossed only in a selected area, or can be combinations of different finishes and textures of embossed patterns. Special mention is made of supports with pattern embossing where the element receiving area is defined by a specific embossed pattern to enhance element removability and where non element receiving areas printed with indicia are not embossed, or are embossed with a different pattern.

Variations of these finishes are controlled by the Ra factor defined as the depth of the peak to the valley of the embossed pattern. Depending on the pattern and thickness of the film, the embossed pattern can be on one side of the film or extend entirely through to both sides. Typically one side is depressed (female) and one is extended (male) once embossed.

Multiple factors come into play when selecting the type of embossed pattern to use for a particular application. One factor is the type of adhesive on the affixed element in terms of aggressiveness (removable or permanent) which dictates the amount of surface area of contact. Depending on the adhesive used to affix the element, the embossed pattern should reduce the surface area of contact from 20-80%. More aggressive adhesives require less surface area contact and less aggressive adhesives require more surface area contact. In general, it has been found in at least one embodiment that a surface area reduction of between 40-60% is preferred.

Another adhesive factor that dictates the embossed depth is the firmness or ability of the adhesive to flow over time. To remove an element with a firm adhesive, it is preferred in at least one embodiment to use the elevated side of the embossed (male) pattern for release because the contact surface area is limited and the extension does not readily penetrate the adhesive without pressure. To remove an element with a soft adhesive, it is preferred in at least one embodiment to use the depressed side of the embossed (female) pattern because it is difficult for the element to conform and penetrate the depressed cavity.

The coat weight or thickness of adhesive that is on the element dictates the depth or Ra factor of the embossed pattern. The greater the adhesive coat weight, the deeper the Ra factor will need to be. Typically the Ra factor from peak to valley should be, in at least one embodiment, at least greater than 25% and more preferably 50-100% the thickness of the adhesive for a firm adhesive and at least greater than 75% and more preferably 100-150% the thickness of the adhesive for a soft adhesive.

The adhesive properties, adhesive coat weight, embossed surface area reduction and depth of emboss all come into play, and not one embossed pattern will work universally with all adhesive elements. With one particular emboss pattern, some low tensile strength elements would remove cleanly and others could destruct. Initially, it may be a trial and error approach to match a particular element with adhesive to an embossed pattern.

In another major aspect, the present invention contemplates a process for the preparation of a durable self-adhesive supports in roll, sheet, fan-fold or rigid form for use as a support for labeling and re-labeling of objects such as signage, containers and the like, the process comprising:

(1) providing a resin film having at least one embossed surface. The resin film has (a) the embossed receiving side and (b) an adhesive side. The receiving side is embossed in a pattern that determines the contact area on a portion of the surface of the pattern and has a depth that will not allow the adhesive on a label element to touch the bottom of the embossed depression and bond to the base film when the label element is applied with initial pressure to the embossed surface of the support. By reducing the surface contact of any adhesive applied thereto, the embossed surface allows release of a pressure sensitive adhesive from a surface on a material that has no inherent release characteristics without starting with a film (before embossing) that is coated or laminated to a material with inherent release characteristics. The embossed surface is adapted to support a removable element such as a substrate or label attachable thereto by means comprising attraction forces between the reduced surface area embossed resin and the pressure sensitive adhesive used to affix the element, such as a sign or label;

(2) locating on the adhesive side of the embossed resin film an adhesive having an ultimate release energy level greater than the attraction forces between the embossed resin film and an adhesive coated element; and (3) optionally, providing a temporary backing in contact with the adhesive on the adhesive side of the embossed resin film, the backing being adapted subsequently to be stripped from contact with the adhesive, thereby providing a support suitable for mounting on an object after first stripping any, optional temporary backing therefrom, and affixing any element such as a label, coupon or signage, at the option of the user, to the embossed receiving side and later separating from the reduced surface area embossed resin film receiving side at a release force effecting such separation, without, at the same time, stripping the embossed resin film from the object the support was affixed to.

Special mention is made of at least one of the preferred embodiments of the process or the invention wherein:

(i) the removable label or labels comprise a pressure-sensitive adhesive-backed label or labels;

(ii) the release force between the label or labels and the embossed resin film having the controlled-release surface without making use of a coated release substance is about 5 to about 200 grams per inch width, and the adhesion energy level of the adhesive used to affix the embossed support to a surface is greater than the release force between the label or labels and the embossed support, especially those wherein the release force between the label or labels and the embossed resin film having the controlled-release surface without making use of a coated release substance is about 20 to about 60 grams per inch width;

(iii) the label or labels comprise paper or a polymer film; especially those wherein the polymer is selected from polyethylene, polypropylene, poly(vinyl chloride), polyester, polyurethane, polycarbonate, polyamide, polystyrene or a blend comprising any of the foregoing;

(iv) the embossed resin film (a) comprises polyethylene, polypropylene, poly(vinyl chloride), polyester, polyurethane, polycarbonate, polyamide, polystyrene or a blend comprising any of the foregoing that has been embossed with a pattern that reduces the surface contact of the support structure to the adhesive on the removable label and special mention is made of embossed support structures wherein:

the embossed resin film (a) is a mono-layer or coextruded film having (A) a label-receiving side comprising an embossed surface where the surface contact area is reduced 20-80% by embossing with an embossed depth of at least 25% of the adhesive thickness on the label, and preferably about 25-100% of the label adhesive thickness and more preferably 50-100% of the label adhesive thickness, a surface tension in the label receiving area of the support of 30-50 dynes/cm, preferably from about 41 to about to 49 dynes/cm and most preferably from about 30 to about 40 dynes/cm and (B) an adhesive side.

Generally, the thickness of the film that is used for making the embossed film will be from 1 to 50 mils in thickness, and in at least one embodiment, preferably 3 to 10 mils and most preferably from 3 to 5 mils.

In another of its major aspects, the present invention contemplates a method of labeling or relabeling an object comprising:

a) providing an embossed support for pressure-sensitive adhesive-backed labels, the support structure comprising a thermoplastic resin film having (A) a label-receiving side and (B) an adhesive side, the label-receiving side consisting of an embossed surface without making use of a coated release substance or without using a wax or release agent in the resin that provides, controlled release through surface contact reduction adapted to support a removable label attachable thereto by means comprising attraction forces between the embossed resin film and the label substrate and the adhesive side with a liner covering the adhesive coating;

b) removing the liner from the adhesive coated side;

c) attaching the embossed support to the object by adhering the laminated support structure to the object using the adhesive coated side; and d) placing a pressure-sensitive adhesive backed label or other adhesive backed removable element on the embossed label-receiving side consisting of the reduced surface contact embossed controlled-release surface without making use of a coated release substance or adding a wax or other release agent to or on the support structure.

It has been found that the key to the easy removal of a paper element, with low tensile strength, which is applied to an embossed support, is the fact that the supports are typically mounted in the vertical position where one label element is affixed with minimal pressure applied by gently rubbing the finger across the surface of the label element. The pressure sensitive adhesive used to affix the element to the vertical support adheres when the element is applied with initial pressure, but is not under constant pressure or load when mounted in the vertical position so the adhesive does not readily flow below the topmost portion of the embossed surface into the lower portions of the embossed surface.

Additional embodiments of this aspect include a method as defined, including the step comprising:

a) removing the label or other adhesive backed element from the embossed support structure while leaving the support structure adhered to the object;

a method as defined, including the step comprising b) replacing the label or other adhesive backed element with another adhesive coated label having different indicia printed thereon by adhering the adhesive coating of the other label or other adhesive backed element to the label-receiving side consisting of the embossed surface without making use of a coated release substance on the support structure.

Optionally, indicia such as “affix label here” or “affix advertising here” or a company name is printed in mirror image on the adhesive side of the embossed support which is captured between the adhesive and the adhesive face of the support or on the embossed face of the support in the non label or other element receiving area. Special mention is made of such methods wherein the object is a product container or an advertising display.

Referring to FIG. 1, a support structure of this invention comprising a polymeric film 1 with an embossed surface 2 defined as the release side is shown. The embossed surface 2 is shown with flat square shaped tops but the invention includes any shaped top element such as points, frustoconical shapes, oblique cut elevated elements and the like. The structure includes essential elements 3 of pressure sensitive adhesive defined on the adhesive side and 4 release liner such as paper or film release liner covering pressure sensitive adhesive 3. Also illustrated in the embodiment of FIG. 1 is the optional, non-critical, but preferred element, reverse printed indicia 5 between the polymeric film and adhesive.

Figure 2:
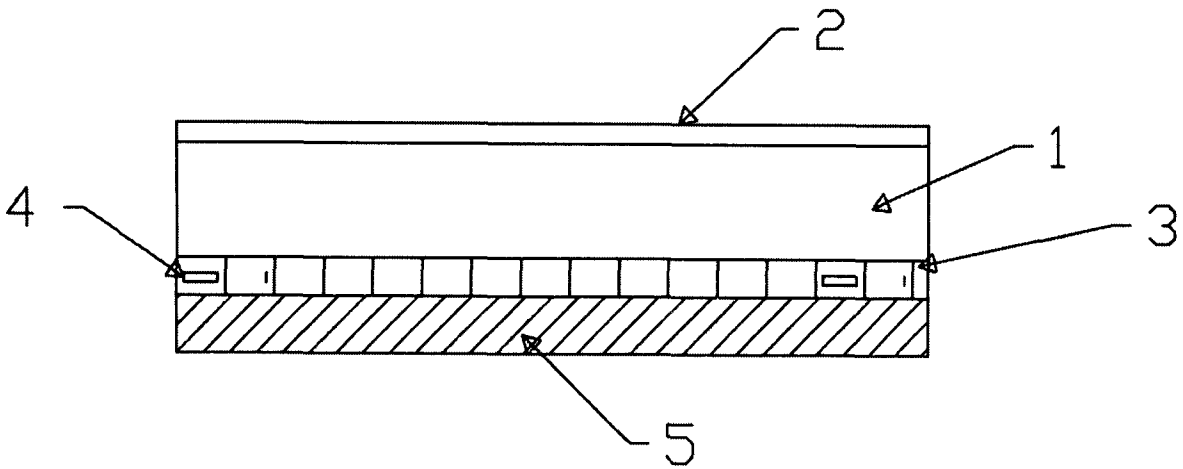
FIG. 2 is a block diagram view, partially exploded of a support structure constructed under prior art U.S. Pat. No. 5,628,858 to Petrou.

Referring to FIG. 2, the block diagram view of the placard structure under the prior art patent to Petrou with polymeric film 1, silicone release coating 2 on the surface of the polymeric film, pressure sensitive adhesive 3, optional printed indicia 4 and silicone release liner 5.

Figure 3:
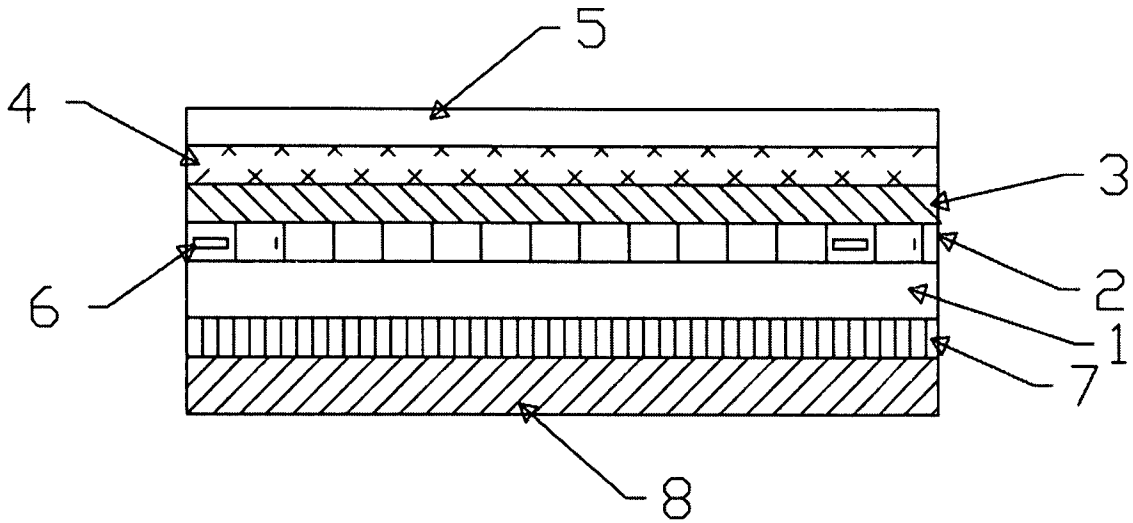
FIG. 3 is a block diagram view, partially exploded of a support structure constructed under prior U.S. Pat. No. 6,986, 826 to Dronzek, Jr.

Referring to FIG. 3, the block diagram view of the prior art multiple layer support structure to Dronzek with polymeric support film 1, pressure sensitive overlaminate adhesive 2, polymeric support layer 3, laminating adhesive layer 4, extruded Teflon® film release layer laminated to polymeric support layer 2 through laminating adhesive layer 4, optional printed indicia 6, pressure sensitive adhesive 7 and release backing 8.

Figure 4:
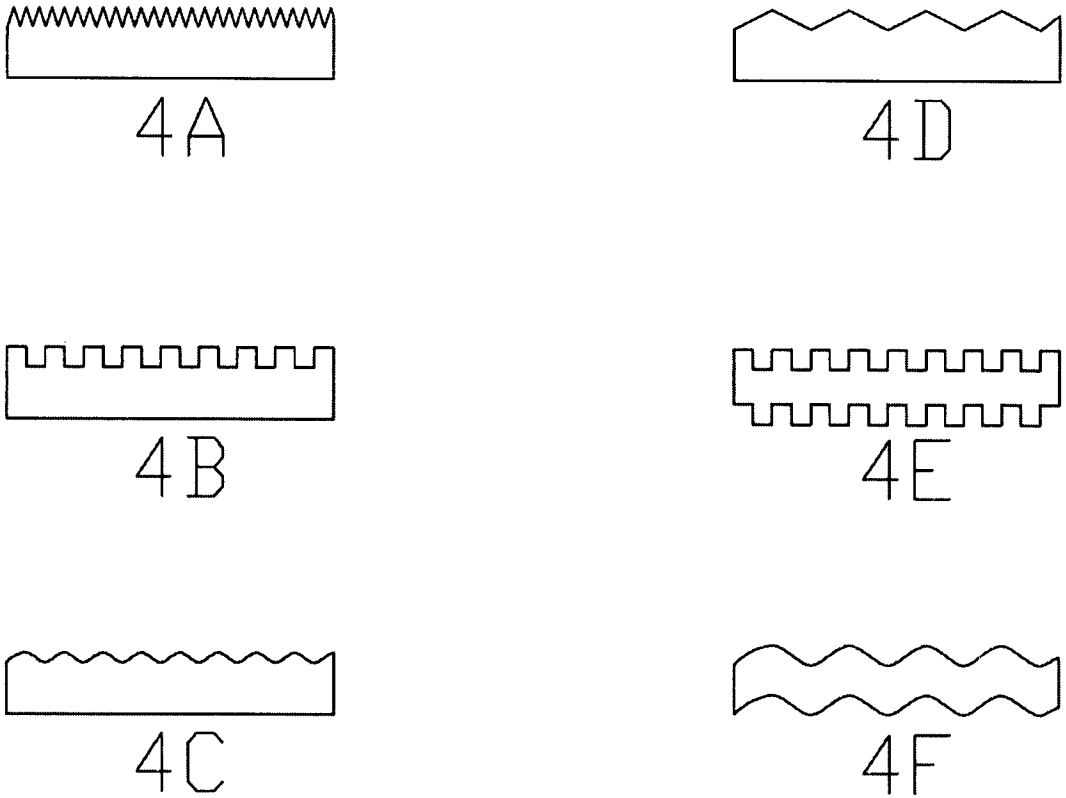
FIG. 4 is a side view illustration of various types of embossed patterns.

Referring to FIG. 4, side view illustrations of various types of embossing patterns on a top surface of a film such as 4A a sand or 4B grit pattern on one side, 4C a contoured wave pattern with rounded depressions one side. The opposite side of the film may be flat, have a complimentary female pattern or a different pattern for the top surface. FIG. 4D is a sharp sloping peak pattern on one side, 4E a block pattern with a sharp square depressions one side and a corresponding sharp square extension on the opposite sides and 4F a complementary wavy pattern with contoured extensions and depressions on both sides.

Figure 5:
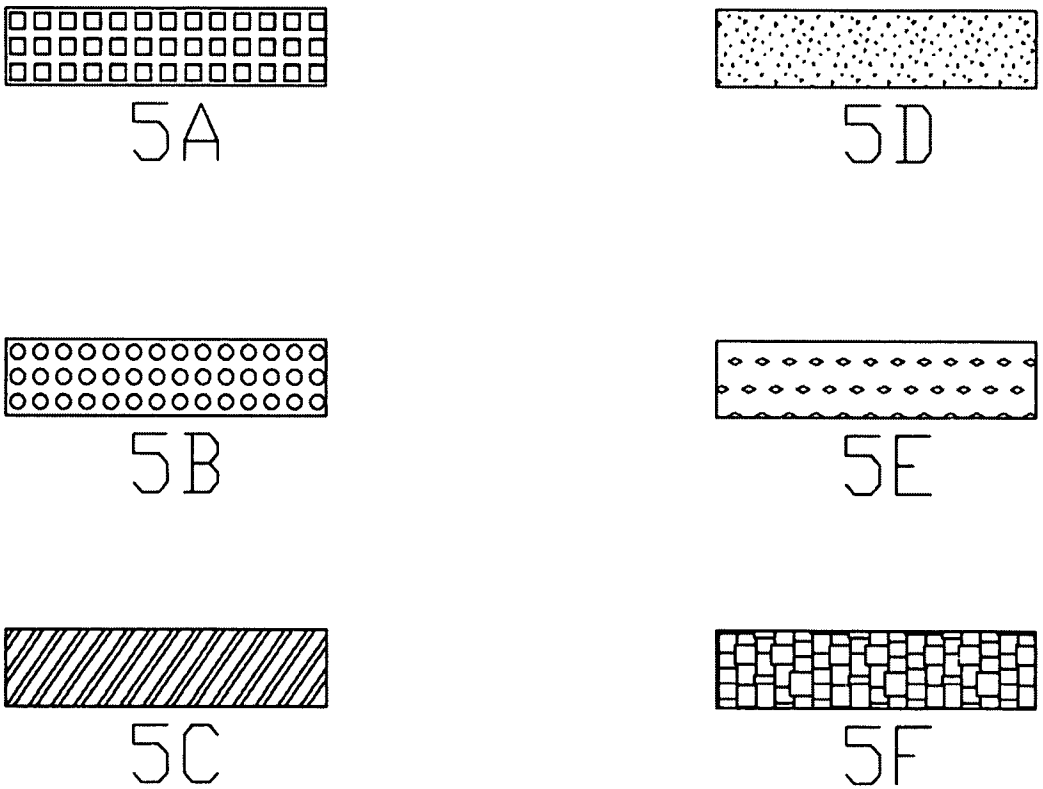
FIG. 5 is a plan view illustration of various types of embossed patterns.

Referring to FIG. 5, a plan view illustration of various types of embossed patterns on a top surface of a film with 5A a sharp square pattern, 5B a circular pattern, 5C a diagonal pattern, 5D a pebble pattern, 5E an "orange peel" pattern and 5F a sand pattern.

Figure 6:
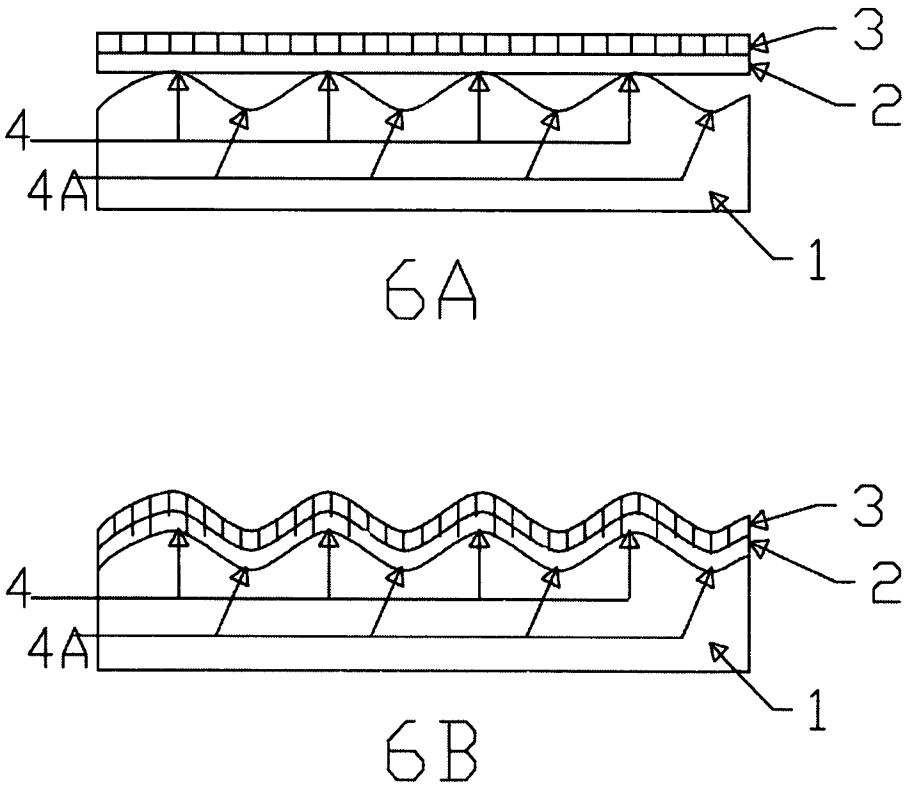
FIG. 6 is a side view of the effect of embossing on surface contact with an adhesive.

Referring to FIG. 6A, a cross-section of a device according to the invention which shows only the elevated peaks 4 of the embossed surface in contact with the adhesive and not the bottoms of the contours 4A. The effect of pressure on surface contact with an adhesive element on embossed pattern 4F where element 3 is shown with pressure sensitive adhesive 2 in contact with the contours of wavy embossed pattern peaks 4 of embossed film 1 contrasted with 6B, the same structure as 6A under pressure where element 3 with pressure sensitive adhesive 2 conforms to the tops of the contours of wavy embossed pattern 4 and the bottoms of the embossed contours of embossed film 1, such as would happen with sheets under pressure or rolls wound with tension. The formation of the structure of FIG. 6B should be avoided in order to minimize the chances of blocking of an adhesive label or other adhesive backed element on the embossed surface. This may achieved by the use of the device of the invention in a vertical position and/or the application of an adhesive label using a sufficient amount of pressure so that the tops of the embossed surface will be in contact with the adhesive but not the lower parts of the embossed surface. Optionally, a stiff element (such as a 40 lb/3000 sq. ft basis weight or higher) should be sufficiently stiff to resist deformation and subsequent blocking.

The support allows for pressure-sensitive elements to be easily removed and replaced as many times as necessary. The elements can be removed without ripping or tearing. The elements are not covered by a plastic envelope, something which results in better bar code scanning. In addition, the object upon the support is mounted on stays free of label and adhesive build-up Adhesives sold by manufacturers that are classified as permanent or removable adhesives can be used as long as they meet the criteria that the bond of the support to the object it is affixed to is stronger than the force required to remove the temporary element (label, coupon or signage) from the embossed surface.

Manufacturing of the supports is enhanced and simplified because indicia can be printed onto the embossed surface, since it is not release coated or made from a material that has release properties. The placards of the Petrou prior art and Dronzek prior art use release coatings and a release film respectively which can not be directly printed on with acceptable indicia adhesion because of the low surface tension of the release coating or Teflon film. If the prior art release systems were surface treated (such as corona, plasma or flame treatment) to raise the surface tension for printing, the removable labels would not release because the adhesive would bond tightly. With this invention, the surface treatment does increase the bond of the adhesive but only at the reduced contact points. If treated for printing the embossed pattern should have a surface area reduction of at least greater than 45% to account for tighter bond at the points of adhesive resin peak contact due to surface treatment.

Cold flow is the tendency of a pressure sensitive adhesive to act like a heavy viscous liquid over long periods of time or when subjected to pressure or placed under load. Phenomena such as oozing, or increases in adhesion, are some results of this characteristic. Ooze occurs when the adhesive squeezes out from under the element due to cold flow of the adhesive. Firm adhesives exhibit minimal ooze, while soft adhesives will exhibit more ooze.

Examples of adhesives that can be used are Techcryl 3120 from Dynatech, of Grafton, W. Va., classified as a "removable" pressure sensitive adhesive that is firm or Aroset 3520 from Ashland, Inc., of Columbus, Ohio, or Covinax 412 from Franklin International, of Columbus, Ohio, classified as "permanent" pressure sensitive adhesives that are soft or Covinax 525 from Franklin International, Columbus, Ohio classified as a "permanent" pressure sensitive adhesive that is firm. Films that can be embossed might generally be available from the Tee Group, Ladd, Ill., a manufacturer of embossed olefin based films, American Profol, of Cedar Rapids, Iowa, a manufacturer of embossed polypropylene films, or Flagship Converting, of Danbury, Conn., a manufacturer of embossed polyester and vinyl films.

Embossed films may then be manufactured from extruded resin films by casting the molten resin on a chilled textured casting drum or by compression through a matched set of male and female textured rolls under pressure, or one textured male roll with a rubber roll under pressure. Additionally textured surfaces can be achieved by chemical etching or laser engraving.

Various embossed patterns in finishes and textures such as orange peel, grit, sand, diamond, taffeta, split diamond and satin may be employed. Variations of these finishes are controlled by the Ra factor defined as the depth of the peak to the valley of the embossed pattern. Depending on the pattern and thickness of the film, the emboss pattern can be on one side of the film or extend entirely through to both sides. Typically one side is depressed (female) and one is elevated (male) once embossed.

Multiple factors come into play when selecting the type of emboss pattern to use for a particular application. One factor is the type of adhesive in terms of aggressiveness (removable or permanent) which dictates the amount of surface area of contact. Depending on the adhesive used to affix the temporary element, the emboss pattern should reduce, in at least one embodiment, the surface area of contact from 20-90%. Another adhesive factor is the firmness or ability to flow over time. To remove an element with a firm adhesive, it is preferred to use the extended side of the embossed material for release, because the contact surface area is limited and the extension does not readily penetrate the adhesive without pressure. To remove an element with a soft adhesive, it is preferred to use the depressed side of the embossed material because it is difficult for the element to conform and penetrate the depressed cavity.

In general, it has been found that a surface area reduction of between 30-60% is preferred in at least one embodiment for a firm adhesive and between 60-90% in at least one other embodiment for a soft adhesive.

Shear resistance may be used to measure the cold flow characteristic of an adhesive for the purpose of selecting an adhesive for use in the present invention. Shear resistance is defined as a measure of the cohesive strength of the adhesive mass and is typically related to the load characteristics and cold flow of the adhesive. While for purposes of this invention the supports will not be under shear or any load in use, the shear resistance of an adhesive is an indicator of the cold flow properties of the adhesive and is a useful in selecting adhesives to be used on elements without cohesive failure when removed. In general, the higher the surface area of contact from a particular embossed pattern, the higher the shear value of the adhesive should be. In at least some preferred embodiments, the shear value should be greater than 100 minutes and more preferably greater than 500 minutes for a 0.25 sq. in. sample with 500 gram load and 10 minute dwell.

Another adhesive factor is the coat weight or thickness of adhesive, whereby the more adhesive that is on the element, the higher the Ra factor will need to be. Typically the Ra factor from peak to valley should be at least 25% the thickness of the adhesive and preferably >50% for a firm adhesive and at least 75% and preferably >100% the thickness of the adhesive for a soft adhesive.

The balance of adhesive properties, surface area reduction and depth of the embossed pattern all come into play, and not one emboss pattern will work universally with all elements. With one particular emboss pattern, some elements would remove cleanly, while others could destruct. Initially, a simple experiment may be undertaken to match a particular embossed pattern with a particular adhesive pattern.

In a general sense, it may behoove one to have a greater number of smaller fine embosses per inch than a smaller number of larger coarse ones because the element will be held at more smaller surface contact points resulting in a more uniform bond instead of less contact points with larger surface contact points and larger gaps of no bond where adhesive could penetrate the aperture of the embossed depression. In a pattern where the embosses are arranged linearly, the number of embosses can range from 10 per inch such as a square pattern to 1000 per inch such as a sand pattern, the preferred range is 100 to 800 per inch and more preferably 200 to 600 per inch for a fine embossed pattern and 20-150 per inch for a coarse pattern. The number of embosses per inch will always be chosen so that the adhesive element will remove cleanly from the support with no substantial adhesive residue.

If the proper adhesive and embossed pattern are selected, it will not be necessary to coat the embossed surface with any type of a release polymer such as a silicone release coating. In addition, metallized surfaces or print receiving surfaces may optionally be employed.

The following examples illustrate the present invention. They are not to be construed to limit the claims in any manner whatsoever.

Example 1

5.5 mil red monolayer polyolefin blend 60% HDPE and 40% LDPE embossed with a fine grit pattern on one side from Tee Industries is corona treated to promote adhesive anchorage and is coated on the smooth back side with Techcryl 3120 removable adhesive from Dynatech at 10 grams per 1000 sq. in. and is then laminated to 40# SCK silicone coated release liner.

Example 2

3 mil blue co-extruded polypropylene embossed with a coarse orange peel pattern on one side from American Profol is corona treated to promote adhesive anchorage and is coated on the smooth back side with Covinax 525 permanent acrylic adhesive from Franklin International, Columbus, Ohio at 12 grams per 1000 sq. in. and is then laminated to 40# SCK silicone coated release liner.

Example 3

The permanent acrylic adhesive available as a 2 liner transfer tape from Strata-Tac, Chicago, Ill. with 1 dry mil of adhesive (~18 grams/1000 sq. in.) was used to laminate the adhesive to the corona treated smooth side of 4.5 mil coextruded embossed polypropylene with a Taffeta pattern from manufacturers such as American Profol.

Example 4

1 mil metallized clear polyester film embossed with a satin pattern having depressions on one side and extensions on the other was coated with Covinax 412 from Franklin International at 20 grams per 1000 sq. in. on the extended side and laminated to 53# silicone coated glassine release liner. The same was then done on the depressed side.

Standard paper shipping labels available from Avery Dennison, Pasadena, Calif., System ID, Plano, Tex. and United Parcel Service, Atlanta, Ga. were affixed to the embossed surfaces of the examples above.

The samples from example 2 were mounted on containers vertically and stored under weight horizontally in laboratory ambient and accelerated aging conditions at 140 degrees F. for 6 months and then checked for removability. All other samples were evaluated at warehouse ambient conditions after 7 days in vertical and horizontal format.

Removal of the low tensile strength paper labels was evaluated and it was found all the vertically mounted samples at ambient and accelerated aging conditions were able to be removed cleanly. The horizontal samples under ambient conditions removed cleanly while the samples under weight (0.25 psi for 6 months 140 degrees F0 could not be removed without damaging the paper labels). The accelerated aged labels showed stronger adhesion over time due to flow of the adhesive but it was minimal when compared to the flow of the adhesive after aging and weight being applied.

I claim:

1. A method of providing a reusable or temporary labeling surface on the surface of an object for receiving a removable element, said method consisting of:

(a) applying, in a substantially vertical mounted position, to the surface of said object, an embossed support comprising a resin film having an RFID chip embedded in said resin as part of said embossed support, wherein:

said resin film is chosen from the group comprising at least one of the following of a thermoplastic resin that does not use a coated release substance and has no inherent release characteristics or a thermoset resin that does not use a coated release substance and has no inherent release characteristics, wherein said resin film is formed from at least one of the following of a roll, a sheet, a fan-fold, or a rigid form, and said resin having a receiving side and an opposite side, and at least one embossed surface on said receiving side for receiving said removable element wherein:

said embossed surface extends through said receiving side, but does not extend through to said opposite side of said resin and is pattern embossed with elevated peaks and in a substantially linear arrangement and has a reduced surface area of contact that reduces a pre-embossed surface area of said receiving side by a factor between 20-80% and allows for removal of said removable element; and (b) providing an affixing element on the opposite side of the resin film of the embossed surface, said affixing element having a bond that is greater than the attraction forces between said embossed surface and said removable element;

wherein said reduced surface area of said embossed surface has been patterned in order to minimize blocking and so as to facilitate the release of the removable element by contacting said removable element only at said elevated peaks of said embossed surface.

2. The method as defined in claim 1 wherein said embossed surface of said resin film is formed with a thickness between 1-50 mils and is formed so as to have an embossed depth between 25-100% as measured peak to valley.

3. The method as defined in claim 2 wherein said embossed surface is formed so as to have a surface tension between 30-50 dynes/cm.

4. The method as defined in claim 3 wherein said reduced surface area is formed so as to have a reduced surface area of contact that reduces said pre-embossed surface area of said receiving side by a factor between 30-60%.

5. The method as defined in claim 3 wherein said reduced surface area is formed so as to have a reduced surface area of contact that reduces said pre-embossed surface area of said receiving side by a factor between 60-80%.

6. The method as defined in claim 3 wherein said embossed support is formed for as a support structure for labeling and relabeling of objects chosen from the group comprising pallet racks, reusable containers, or reusable marketing signage.

7. The method as defined in claim 6 wherein said step of providing an affixing element includes provision of at least one of the following chosen from the group comprising bolts, lamination to a magnetic element, or rivets.

8. The method as defined in claim 6 wherein said step of providing an affixing element comprises use of application of an adhesive with a temporary backing.

9. The method as defined in claim 6 wherein said embossed surface is further formed by:

providing a removable label on said embossed support that contains at least one of the following of customer order information, serial number, part number or manufacturing directions placed on said embossed support.

10. The method as defined in claim 9 wherein said embossed surface is further formed by:

printing manufacturers indicia printed on said embossed support.

* * * * *